US006284174B1

(12) United States Patent
Ueda et al.

(10) Patent No.: US 6,284,174 B1
(45) Date of Patent: Sep. 4, 2001

(54) MELT SPINNING PACK AND SYNTHETIC FIBER MANUFACTURING METHOD

(75) Inventors: Kunihiko Ueda, Shizuoka; Toshio Nishitani, Osaka; Hiroki Furuta, Kyoto; Teruaki Saijo, Ishikawa; Kanji Saito, Aichi; Hiroshi Kato, Gifu; Hiroshi Ohtani, Shiga; Shinji Shimizu, Ishikawa; Koji Hashimoto, Shizuoka, all of (JP)

(73) Assignee: Toray Industries, Inc. (JP)

( * ) Notice: Subject to any disclaimer, the term of this patent is extended or adjusted under 35 U.S.C. 154(b) by 0 days.

(21) Appl. No.: 09/424,954

(22) PCT Filed: Mar. 25, 1999

(86) PCT No.: PCT/JP99/01531

§ 371 Date: Dec. 6, 1999

§ 102(e) Date: Dec. 6, 1999

(87) PCT Pub. No.: WO99/51798

PCT Pub. Date: Oct. 14, 1999

(30) Foreign Application Priority Data

Apr. 7, 1998 (JP) ..... 10-94934

(51) Int. Cl.[7] ..... D01D 1/10; D01D 4/06; D01F 1/09

(52) U.S. Cl. ..... 264/104; 264/169; 264/211; 425/198; 425/464

(58) Field of Search ..... 264/104, 169, 264/211; 425/198, 464

(56) References Cited

U.S. PATENT DOCUMENTS

| | | | | |
|---|---|---|---|---|
| 3,336,633 | * | 8/1967 | Curran, Jr. | 425/464 |
| 3,938,925 | * | 2/1976 | Lees | 425/198 |
| 5,147,197 | * | 9/1992 | Hodan et al. | 425/464 X |

FOREIGN PATENT DOCUMENTS

| | | | |
|---|---|---|---|
| 39-24309 | | 10/1964 | (JP) . |
| 43-7734 | * | 4/1969 | (JP) . |
| 47-21249 | * | 6/1972 | (JP) . |
| 53-34018 | * | 3/1978 | (JP) . |

* cited by examiner

*Primary Examiner*—Leo B. Tentoni
(74) *Attorney, Agent, or Firm*—Schnader Harrison Segal & Lewis LLP

(57) ABSTRACT

A melt spinning pack, including a pack case, a spinneret having many spinning holes positioned at the bottom of the case, a pack cap having a polymer introducing hole at the center positioned at the top of the case, and a flow arranging plate having many flow arranging holes with restricted portions reduced in cross sectional area compared to the inlets of the holes positioned between the spinneret and the pack cap, satisfying the requirement that the contraction percentage R be 50% or less, respectively contained in the case.

29 Claims, 4 Drawing Sheets

MELT SPINNING PACK AND SYNTHETIC FIBER MANUFACTURING METHOD

TECHNICAL FIELD

The present invention relates to a melt spinning pack used for producing synthetic fibers, and a method for producing synthetic fibers using it.

BACKGROUND ART

The conventional melt spinning pack used for producing synthetic fibers comprises the following parts.

The pack comprises a cylindrical pack case opened in the bottom surface and the top surface, and a spinneret having many spinning holes, a pressure plate having many polymer flowing holes, a wire mesh filter, a cylindrical filter medium containing-spacer, a granular filter bed (usually called a sand bed) contained inside the spacer, and also a pack cap having a polymer introducing hole at the center for introducing a molten polymer and installed to close the top surface of the pack case, respectively contained in this order from bottom to top in the pack case, and also has a first space formed between the bottom surface of the pack cap and the top surface of the granular filter medium, and a second space formed between the top surface of the spinneret and the bottom surface of the pressure plate.

The pack case, spinneret, pressure plate, filter medium-containing spacer and pack cap are usually respectively made of metal.

The granular filter bed is usually a layer of sand consisting of stainless steel particles, glass particles or quartz particles.

The molten polymer as a raw material for producing synthetic fibers is introduced into the first space from the polymer introducing hole formed at the center of the pack cap, passes through the granular filter bed (sand bed) and the wire mesh filter, and further through the many polymer flowing holes of the pressure plate, flows into the second space, and reaches the many spinning holes of the spinneret.

The molten polymer flowing into the many spinning holes passes through these spinning holes and is spun from the spinning holes to form many filaments. The filaments are cooled to form a yarn comprising the multifilament. The yarn is wound around a bobbin installed on a winder. Thus, synthetic fibers are produced.

In some cases, the many filaments are divided into several groups, say, 2 to 4 groups, and the many filaments of each group are formed as one yarn respectively. In this case, from one melt spinning pack, a plurality of, that is, 2 to 4 yarns are produced.

The conventional melt spinning pack has the following problems.

The flowing of polymer which is introduced through the polymer introducing hole provided at the center of the pack cap and flowed into the first space and further come into the granular filter bed (sand bed) is distributed densely in the central region thereof and is less likely to reach the peripheral region. So, the many filaments obtained from the many spinning holes of the spinneret become different from each other in filament diameter and it causes a problem of unevenness of fineness.

Furthermore, the granular filter bed (sand bed) has avoid volume of usually about 40% therein. This means that the granular filter bed (sand bed) has a void of about 40% to allow polymer flow. This structure elongates the dwell time of the polymer in the granular filter bed (sand bed). As a result, the passing time of polymer from introducing from the polymer introducing hole of the pack cap to spinning from the many spinning holes of the spinneret, i.e., the dwell time of the polymer in the pack becomes long. If the dwell time is long, the polymer is deteriorated during the dwell time. The deterioration of the polymer occurs locally in the pack, and at the places at which the polymer is deteriorated and to which the deteriorated polymer moves, it remains in the pack to cause abnormal dwelling. The abnormal dwelling in the pack also causes the filaments to be uneven in fineness. Furthermore, if the deteriorated polymer is spun from the spinning holes, the obtained filaments become irregular in quality in the longitudinal direction, and the filaments are broken before arriving at the winder.

On the other hand, Japanese Publication (Kokaku) No. SHO 39-24309 proposes the following idea for a melt spinning pack.

The spinning pack has a flow arranging plate provided with many flow arranging holes and having a concave bottom surface. The structure is intended to make different in length the many flow arranging holes between the top surface and the bottom surface of the flow arranging plate and to produce uniform polymer flow to the spinneret having many spinning holes.

However, it was found that even if fibers were produced by using the spinning pack, the obtained fiber bundle had relatively great difference of fineness between the filaments. One of the reasons is estimated to be that the space formed between the bottom surface of the flow arranging plate and the top surface of the spinneret has a form likely to cause abnormal dwelling of the polymer.

The above problems of the conventional melt spinning packs arise more remarkably when a yarn is produced from a molten polyester containing an electro-control agent.

Disclosure of the Invention

The object of the present invention is to solve the above problems of the prior art by providing a melt spinning pack capable of producing yarns with good quality less uneven in fineness respectively comprising filaments less uneven in fineness, and a method for producing synthetic fibers by using the pack.

The present invention concerning the melt spinning pack for achieving the above object is as follows:

A melt spinning pack, comprising (a) a cylindrical pack case opened in the bottom surface and the top surface, (b) a spinneret having many spinning holes, positioned to close the opening in the bottom surface of the pack case, (c) a flow arranging plate having many flow arranging holes, positioned above the spinneret, (d) a pack cap having a polymer introducing hole at the center, positioned above the flow arranging plate and positioned to close the opening in the top surface of the pack case, (e) a first space in which the outlet of the polymer introducing hole in the bottom surface of the pack cap and the inlets of the flow arranging holes in the top surface of the flow arranging plate are opened, (f) a second space in which the outlets of the flow arranging holes in the bottom surface of the flow arranging plate and the inlets of the spinning holes in the top surface of the spinneret are opened, and in which the space thickness in the central axis direction of the pack case is substantially uniform in the entire range of the space, and (g) restricted portions reduced in cross sectional area compared to the inlets of the flow arranging holes, formed in the respective flow arranging holes in the respective sections between the inlets of the flow arranging holes and the outlets of the flow arranging holes.

In the present invention, the conventionally used granular filter bed (sand bed) is not used, and a flow arranging plate having many flow arranging holes is positioned between the first space in which the outlet of the polymer introducing hole in the bottom surface of the pack cap and the inlets of the flow arranging holes in the top surface of the flow arranging plate are opened and the second space in which the outlets of the flow arranging holes in the bottom surface of the flow arranging plate and the inlets of the spinning holes in the top surface of the spinneret are opened. Furthermore, restricted portions reduced in cross sectional area compared to the inlets of the flow arranging holes are formed in the respective sections between the inlets of the flow arranging holes and the outlets of the flow arranging holes. Therefore, in the respective first and second spaces, the polymer can be distributed more uniformly compared to the distribution achieved by the conventional pack.

The following embodiments are preferable in the present invention.

Embodiment 1: In the present invention, the number of flow arranging holes in the peripheral region of the flow arranging plate is larger than that at the central region of the flow arranging plate.

Embodiment 2: In the present invention, the cross sectional area of the restricted portions of the flow arranging holes positioned in the peripheral region of the flow arranging plate is smaller than the cross sectional area of the restricted portion(s) of the flow arranging hole(s) positioned in the central region of the flow arranging plate, and if flow arranging holes are positioned also in the intermediate region between the peripheral region and the central region, the cross sectional area of the restricted portions of the flow arranging holes positioned in the intermediate region is not smaller than the cross sectional area of the restricted portions of the flow arranging holes positioned in the peripheral region and not larger than the cross sectional area of the restricted portion(s) of the flow arranging hole(s) positioned in the central region.

This embodiment means that if one of the many flow arranging holes is positioned at the center of the flow arranging plate while the other flow arranging holes are positioned on one geometrical line around the center, the cross sectional area of the restricted portions of the flow arranging holes positioned on the one geometrical line is smaller than the cross sectional area of the restricted portion of the flow arranging hole positioned at the center.

Furthermore, this embodiment means that when there are a plurality of geometrical lines around the center, with the other flow arranging holes positioned on the plurality of geometrical lines, the cross sectional area of the restricted portions of the flow arranging holes positioned on the geometrical lines described between the center and the outermost geometrical line is equal to the cross sectional area of the flow arranging hole positioned at the center, or equal to the cross sectional area of the restricted portions of the flow arranging holes positioned on the outermost geometrical line, or smaller than the cross sectional area of the restricted portion the flow arranging hole positioned at the center and larger than the cross sectional area of the restricted portions of the flow arranging holes positioned on the outermost geometrical line.

Moreover, this embodiment means that if there is no flow arranging hole at the center, similar relations apply to the innermost geometrical line, the outermost geometrical line and the geometrical lines described between them.

Embodiment 3: In the present invention, the length of the restricted portions of the flow arranging holes positioned in the peripheral region of the flow arranging plate is longer than the length of the restricted portion(s) of the flow arranging hole(s) positioned in the central region of the flow arranging plate, and if flow arranging holes are positioned also in the intermediate region between the peripheral region and the central region, the length of the restricted portions of the flow arranging holes positioned in the intermediate region is not longer than the length of the restricted portions of the flow arranging holes positioned in the peripheral region and not shorter than the length of the restricted portion(s) of the flow arranging hole(s) positioned in the central region.

The meaning of this embodiment can be understood by replacing the cross sectional area of the restricted portions in the explanation for the above embodiment 2 by the length of the restricted portions.

Embodiment 4: In the present invention, the form of the top surface of the flow arranging plate is upwardly conical or pyramidal and the form of the bottom surface of the pack cap is conical or pyramidal to respond to the conical or pyramidal top surface of the flow arranging plate, with the first space formed between the two conical or pyramidal surfaces.

Embodiment 5: In the present invention, an integral filter plate formed by an integral filter medium is provided in the first or second space.

Embodiment 6: In the present invention, the space thickness of the second space is about 1 mm to about 60 mm. It is preferable for preventing the abnormal dwelling and shortening the dwell time of the polymer, that the space thickness of the second space is in this range.

Embodiment 7: In the present invention, the inner peripheral surface of the cylindrical pack case, the outer peripheral surface of the flow arranging plate and the outer peripheral surface of the pack cap are respectively circular in cross sectional form (hereinafter, this pack is called the circular pack of the present invention).

The circular pack of the present invention can be provided in the following preferable embodiments.

Embodiment 8: In the circular pack of the present invention, the flow arranging holes are positioned in such a manner that the centers of the flow arranging holes are positioned on a hole positioning circle described around the center of the top surface of the flow arranging plate, or positioned at the center of the top surface of the flow arranging plate and on a hole positioning circle described around said center.

The former half of this embodiment means a case where there is no flow arranging hole at the center of the flow arranging plate, and the latter half means a case where there is a flow arranging hole at the center of the flow arranging plate.

Embodiment 9: In the circular pack of the present invention, a plurality of concentric hole positioning circles are described instead of said one hole positioning circle.

Embodiment 10: In the circular pack of the present invention, the number of flow arranging holes positioned on a hole positioning circle described in the peripheral region of the flow arranging plate is larger than the number of flow arranging holes positioned on a hole positioning circle described in the central region of the flow arranging plate.

Embodiment 11: In the circular pack of the present invention, the cross sectional area of the restricted portions of the flow arranging holes positioned on the outermost hole positioning circle of the flow arranging plate is smaller than the cross sectional area of the restricted portion(s) of the flow arranging hole(s) positioned in the innermost central region of the flow arranging plate, and if there is an intermediate hole positioning circle between the outermost hole positioning circle and the flow arranging hole(s) positioned in the innermost central region, the cross sectional area of the restricted portions of the flow arranging holes positioned on the intermediate hole positioning circle is not smaller than the cross sectional area of the restricted portions of the flow arranging holes positioned on the outermost hole positioning circle and not larger than the cross sectional area of the restricted portion(s) of the flow arranging hole(s) positioned in the innermost central region.

The meaning of this embodiment can be understood by replacing the geometrical lines in the explanation for the embodiment 2 by hole positioning circles.

Embodiment 12: In the circular pack of the present invention, the length of the restricted portions of the flow arranging holes positioned on the outermost hole positioning circle of the flow arranging plate is longer than the length of the restricted portion(s) of the flow arranging hole(s) positioned in the innermost central region of the flow arranging plate, or if there is an intermediate hole positioning circle between the outermost hole positioning circle and the flow arranging hole(s) positioned in the innermost central region, the length of the restricted portions of the flow arranging holes positioned on the intermediate hole positioning circle is not longer than the length of the restricted portions of the flow arranging holes positioned on the outermost hole positioning circle and not shorter than the length of the restricted portion(s) of the flow arranging hole(s) positioned in the innermost central region.

The meaning of this embodiment can be understood by replacing the geometrical lines in the explanation of the embodiment 2 by hole positioning circles.

Embodiment 13: In the circular pack of the present invention, the form of the top surface of the flow arranging plate is upwardly conical, and the form of the bottom surface of the pack cap is conical to respond to the conical top surface of the flow arranging plate, with the first space formed between the two conical surfaces.

Embodiment 14: In the circular pack of the present invention, an integral filter plate formed by an integral filter medium is provided in the first or second space.

Embodiment 15: In the circular pack of the present invention, the space thickness of the second space is about 1 mm to about 60 mm. It is preferable for preventing the abnormal dwelling and shortening the dwell time of the polymer, that the space thickness of the second space is in this range.

The method for producing synthetic fibers of the present invention to achieve the object is a method for producing synthetic fibers, in which the melt spinning pack stated in the above present invention or any of the preferable embodiments is used, comprising the steps of introducing a molten polymer from the polymer introducing hole of the pack cap, spinning many filaments from the spinning holes of the spinneret and cooling the filaments to form a yarn.

In the method for producing synthetic fibers, an embodiment in which- the molten polymer is a polyester containing an electro-control agent is preferable.

Since polyester fibers with electro-controllability are lower in electric resistance than ordinary polyester fibers, they are less likely to be charged with static electricity, and are used as fibers for clothing.

To produce polyester fibers with electro-controllability, usually a polymer in which an electro-control substance (electro-control agent) for giving electro-controllability coexists with a polyester is prepared for melt spinning. The polymer is supplied into a heated melt spinning pack, and extruded from the many spinning holes of the spinneret installed in the bottom surface of the pack, to form many filaments, and from the filaments, polyester fibers with electro-controllability are produced.

However, most of electro-control substances used are lower in heat resistance than ordinary polyesters. Therefore, when a polyester containing an electro-control agent is spun using any conventional melt spinning pack, the polymer is more thermally deteriorated in the pack than an ordinary polyester, and it may be difficult to produce electro-controllable fibers with good quality. To solve the problem, the melt spinning pack of the present invention which allows the polymer to dwell in it for a shorter period of time than the conventional pack can be preferably used.

Usually used electro-control agents include the following:

Ethylene oxide condensation products, propylene oxide condensation products, polyalkylene ether (polyalkylene oxide) as the condensation product of ethylene oxide and propylene oxide, olyether amides obtained by letting an aminocarboxylic acid, lactam, diamine, dicarboxylic acid or dicarboxylate react with a polyalkylene oxide, polyether esters, polyether ester amide block copolymers.

Any of these electro-control agents is usually used by about 0.2 wt % to about 5 wt % based on the weight of the polymer.

THE BEST EMBODIMENTS OF THE INVENTION

At first, the conventional melt spinning pack will be described below more specifically, and subsequently the melt spinning pack and the method for producing synthetic fibers of the present invention will be described in more detail.

Figure 1:
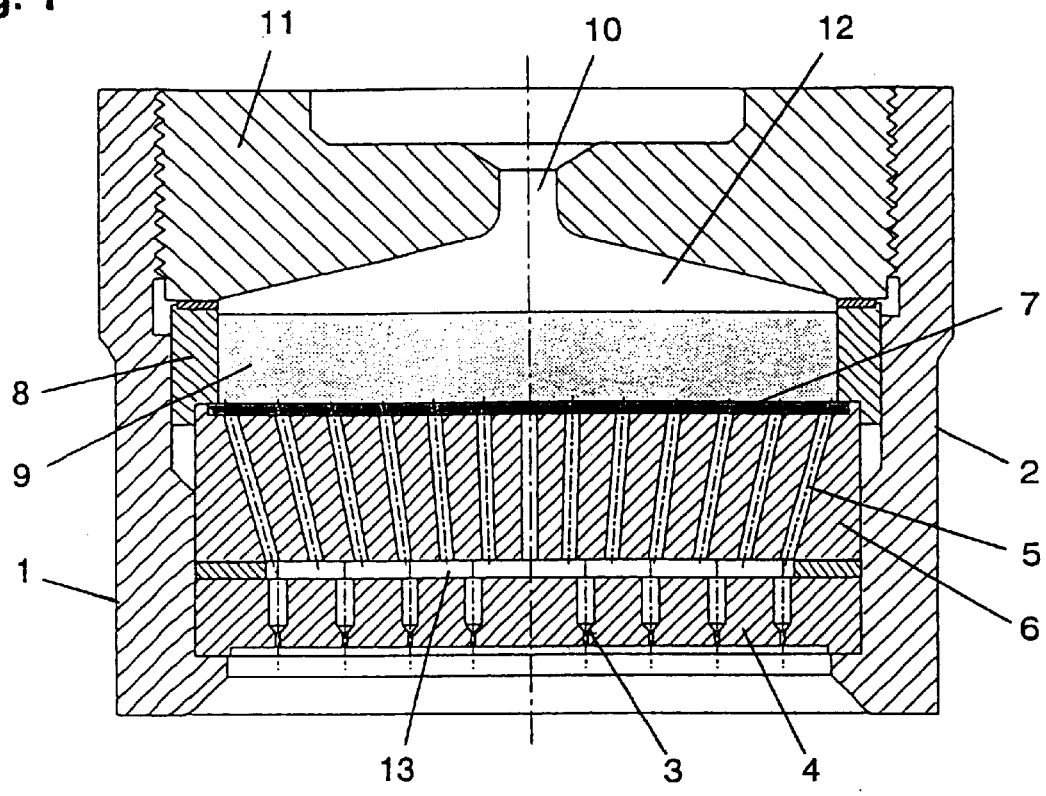
FIG. 1 is a vertical sectional view showing a conventional melt spinning pack.

FIG. 1 is a vertical sectional view showing the melt spinning pack conventionally used in the field of melt spinning. In FIG. 1, the pack 1 comprises a cylindrical pack case 2 opened in the bottom surface and the top surface, and a spinneret 4 having many spinning holes 3, a pressure plate 6 having many polymer flowing holes 5, a wire mesh filter 7, an annular filter medium-containing spacer 8, a granular filter bed (usually called a sand bed) 9 contained inside the spacer 8, and also a pack cap 11 having a polymer introducing hole 10 at the center for introducing a molten polymer and positioned to close the top surface of the pack case 2, respectively contained in this order from bottom to top in the pack case 2, and also has a first space 12 formed between the bottom surface of the pack cap 11 and the top surface of the granular filter medium 9, and a second space 13 formed between the top surface of the spinneret 4 and the bottom surface of the pressure plate 6.

In the pack 1, the pack case 2, the spinneret 4, the pressure plate 6, the filter medium-containing spacer 8 and the pack cap 11 are usually made of any metal respectively.

The granular filter bed 9 is usually a layer of sand consisting of stainless steel particles, glass particles or quartz particles.

The molten polymer as a raw material for producing synthetic fibers is introduced into the first space 12 from the polymer introducing hole 10 at the center of the pack cap 1 and passes through the granular filter bed (sand bed) 9 and the wire mesh filter 7 and further through the many polymer flowing holes 5 of the pressure plate 6, flowing into the second space 13, to reach the many spinning holes 3 of the spinneret 4.

The molten polymer flowing into the many spinning holes 3 passes through these spinning holes 3 and is spun from the spinning holes 3 and formed into many filaments (not illustrated). These filaments are cooled to form a yarn (not illustrated) as a bundle of multi-filaments. The yarn is wound around a bobbin (not illustrated) installed on a winder (not illustrated). Thus, synthetic fibers are produced.

The conventional melt spinning pack has the problems as described before.

Several embodiments of the melt spinning pack of the present invention to solve the problems are described below.

Figure 2:
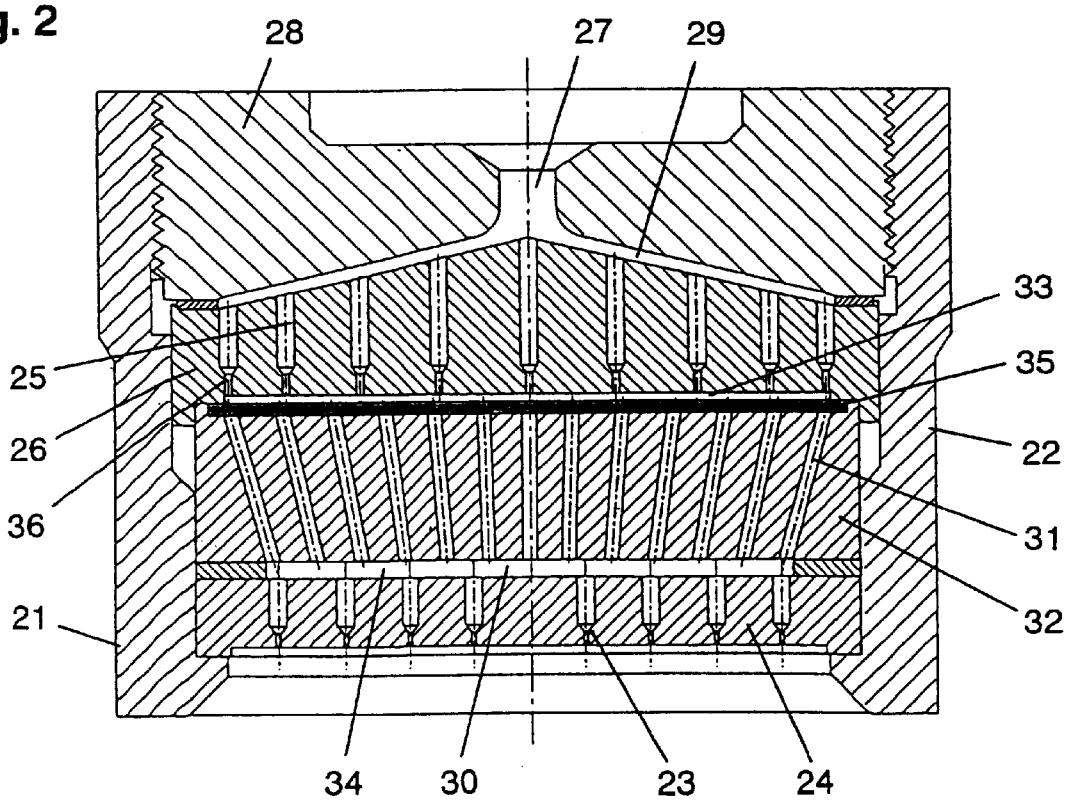
FIG. 2 is a vertical sectional view showing an example of the melt spinning pack of the present invention.

FIG. 2 is a vertical sectional view showing an example of the melt spinning pack of the present invention.

The pack 21 shown in FIG. 2 comprises a cylindrical pack case 22 opened in the bottom surface and the top surface, a spinneret 24 having many spinning holes 23, a flow arranging plate 26 having many flow arranging holes 25, and a pack cap 28 having a polymer introducing hole 27 at the center, respectively contained in this order from the bottom to the top of the pack case 22. The opening in the bottom surface of the pack case 22 is closed by the spinneret 24. The opening in the top surface of the pack case 22 is closed by the pack cap 28.

Between the bottom surface of the pack cap 28 and the top surface of the flow arranging plate 26, a first space 29 in which the outlet of the polymer introducing hole 27 and the inlets of the flow arranging holes 25 are opened is formed. Between the bottom surface of the flow arranging plate 26 and the top surface of the spinneret 24, a second space 30 in which the outlets of the flow arranging holes 25 and the inlets of the spinning holes 23 are opened is formed.

The top surface of the flow arranging plate 26 is upwardly conical, and the bottom surface of the pack cap 28 is also upwardly conical to respond to the top surface of the flow arranging plate 26. The space between the two conical surfaces is the first space 29. The vertical height of the clearance formed between the two conical surfaces is almost uniform in the entire range from the outlet of the polymer introducing hole 27 to the periphery of the first space 29.

The second space 30 is divided into an upper space 33 and a lower space 34 by a pressure plate 32 having the many polymer flowing holes 31 at an intermediate position of the second space 30 in the vertical direction. In the upper space 33, an integral filter plate 35 is placed on the top surface of the pressure plate 32.

In this pack 21, the many flow arranging holes 25 of the flow arranging plate 26 have restricted portions 36 reduced in cross sectional area compared to the inlets of the holes, in the sections between the inlets and outlets of the flow arranging holes 25.

Figure 7:
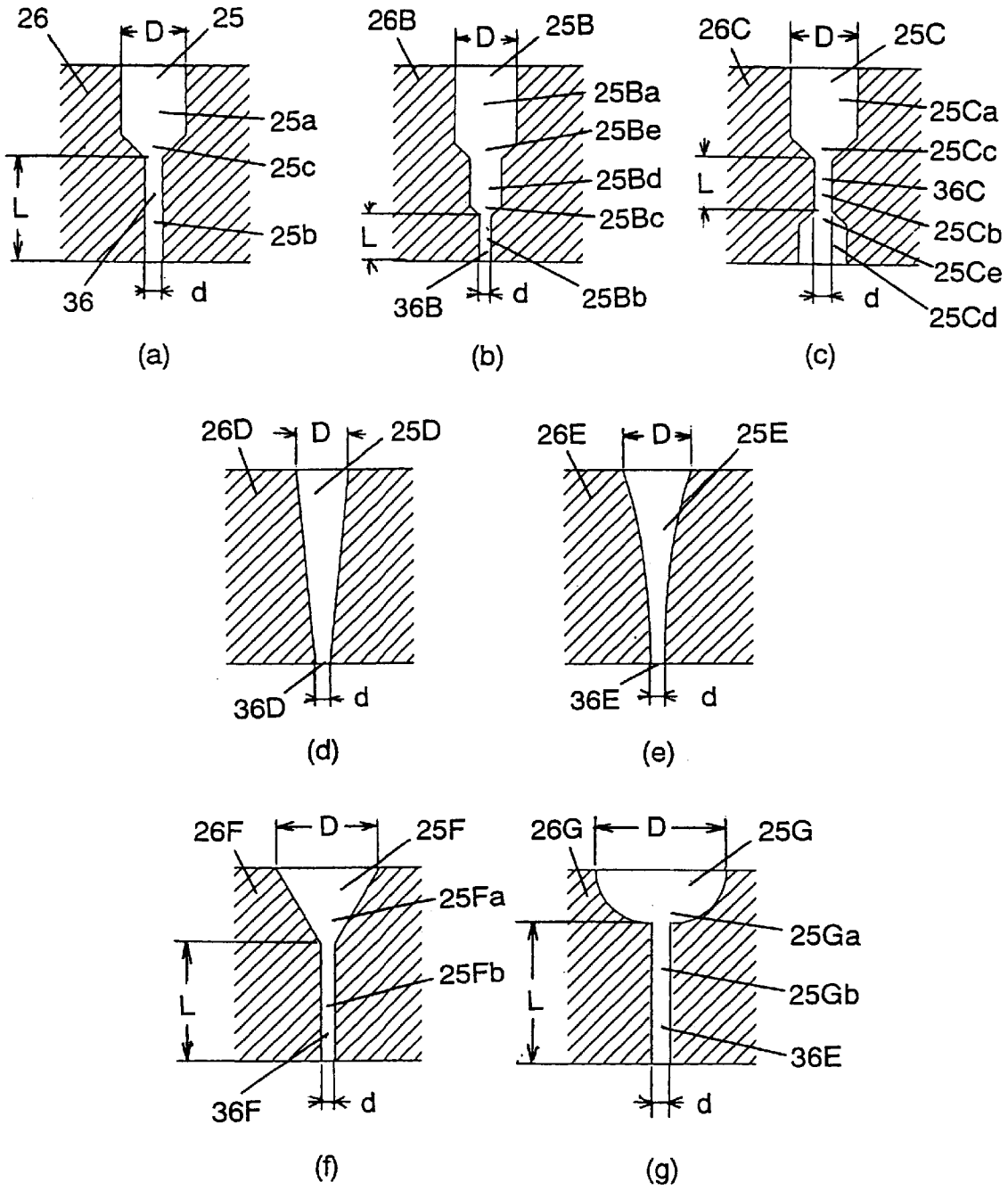
FIGS. 7 are vertical sectional views showing seven examples ((*a*) to (*g*)) of the flow arranging holes formed in the flow arranging plate of the melt spinning pack of the present invention.

FIG. 7(*a*) is a vertical sectional view showing one of the flow arranging holes 25. Each of the flow arranging holes 25 comprises a cylindrical hole (upper hole) 25*a* with diameter D formed downward from the inlet, a cylindrical hole (lower hole) 25*b* with diameter d smaller than the diameter D formed upward from the outlet and a truncated-conical hole (connecting hole) 25*c* with the diameter gradually reduced from top to bottom, connected to the bottom end of the upper hole 25*a* and the top end of the lower hole 25*b*. The lower hole 25*b* forms a restricted portion 36 in contrast to the upper hole 25*a*. The lower holes 25*b* forming the restricted portions 36 of the respective flow arranging holes 25 positioned in the central to peripheral regions of the flow arranging plate 26 are equal in diameter d and axial length L.

In FIG. 2, if the pressure acting on the top surface of the spinneret 24 is not so large as to deform the spinneret 24, the pressure plate 32 is not required to be used. In this case, the integral filter plate 35 is placed on the top surface of the spinneret 24 in the second space 30.

When the pressure plate is used, the space thickness of the second space means the space thickness of said upper space.

It is preferable that the space thickness of the upper space is about 1 mm to about 5 mm. A more preferable range is about 2 mm to about 3 mm.

It is preferable that the space thickness of the lower space is about 1 mm to about 5 mm. A more preferable range is about 2 mm to about 3 mm.

In the pack 21, a pressurized molten polymer flows into the first space 29 from the polymer introducing hole 27 of the pack cap 28. The introduced polymer fills the first space 29. The polymer filling the first space 29 flows into the upper holes 25*a* of the respective flow arranging holes 25, and passes through the connecting holes 25*c* and the lower holes 25*b*, flowing into the upper space 33 of the second space 30.

The polymer flowing into the upper space 33 of the second space 30 passes through the integral filter plate 35 and further through the many polymer flowing holes 31 of the pressure plate 32 into the lower space 34 of the second space 30, to fill the lower space 34. The polymer filling the lower space 34 is continuously extruded as filaments from the respective spinning holes 23 of the spinneret 24. The extruded many filaments are cooled to form a yarn.

The filaments of the obtained yarn are less uneven in fineness. The reason is that the pack 21 has the restricted portions 36 in the flow arranging holes 25 of the flow arranging plate 26. If the unevenness of fineness is still large, the relation between the diameter D of the upper hole 25*a* and the diameter d of the lower hole 25*b* of each flow arranging hole 25 can be changed to lessen the unevenness of fineness.

Figure 3:
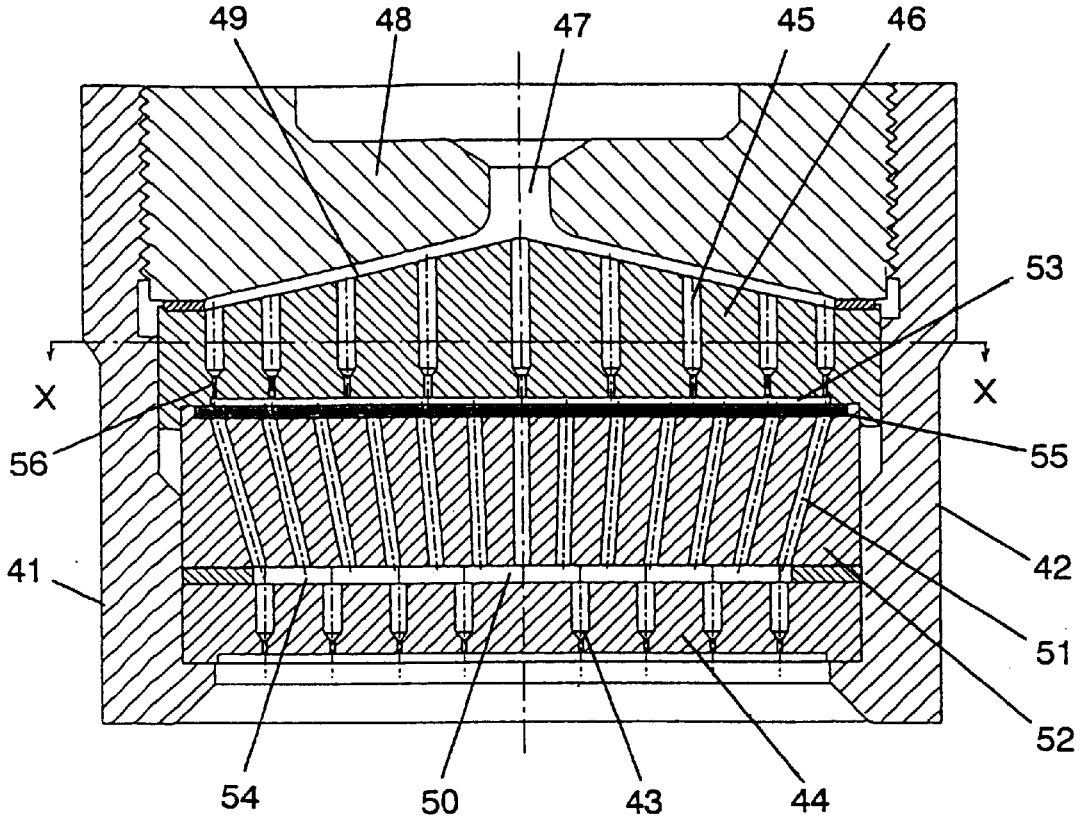
FIG. 3 is a vertical sectional view showing another example of the melt spinning pack of the present invention.
Figure 4:
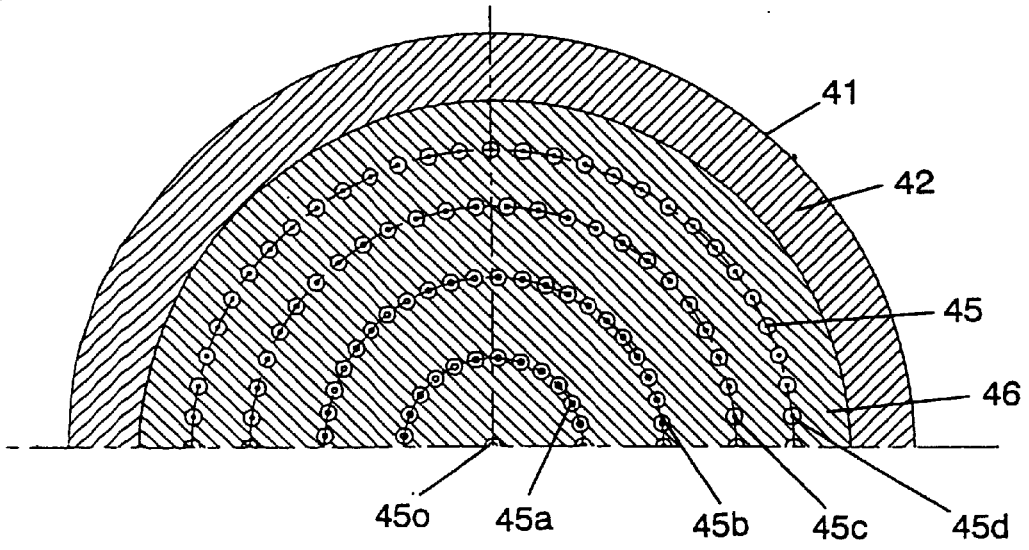
FIG. 4 is a cross sectional view showing a half of the X—X arrow section of FIG. 3.

FIG. 3 is a vertical sectional view showing another example of the melt spinning pack of the present invention. FIG. 4 is a cross sectional view showing a half of the X—X arrow section of FIG. 3.

The pack 41 shown in FIGS. 3 and 4 comprises a cylindrical pack case 42 opened in the bottom surface and the top surface, and a spinneret 44 having many spinning holes 43, a flow arranging plate 46 having many flow arranging holes 45 and a pack cap 48 having a polymer introducing hole 47 at the center, respectively contained in this order from the bottom to the top of the pack case 42. The opening in the bottom surface of the pack case 42 is closed by the spinneret 44. The opening in the top surface of the pack case 42 is closed by the pack cap 48.

Between the bottom surface of the pack cap 48 and the top surface of the flow arranging plate 46, a first space 49 in which the outlet of the polymer introducing hole 47 and the inlets of the flow arranging holes 45 are opened is formed. Between the bottom surface of the flow arranging plate 46 and the top surface of the spinneret 44, a second space 50 in which the outlets of the flow arranging holes 45 and the inlets of the spinning holes 43 are opened is formed.

The top surface of the flow arranging plate 46 is upwardly conical, and the bottom surface of the pack cap 48 is also upwardly conical to respond to the conical top surface of the flow arranging plate 46. The space between the two conical surfaces is the first space 49. The vertical height of the clearance formed between the two conical surfaces is almost uniform in the entire range from the outlet of the polymer introducing hole 47 to the periphery of the first space 49.

The second space 50 is divided into an upper space 53 and a lower space 54 by a pressure plate 52 having many polymer flowing holes 51 at an intermediate position of the second space 50 in the vertical direction. In the upper space 53, an integral filter plate 55 is placed on the top surface of the pressure plate 52.

In this pack 41, the many flow arranging holes 45 of the flow arranging plate 46 have restricted portions 56 reduced in cross sectional area compared to the inlets of the holes, in the sections between the inlets and the outlets.

The flow arranging holes 45 have the same form as the flow arranging holes 25 explained in reference to FIG. 2 and FIG. 7(*a*).

As for the difference between the respective flow arranging holes 25 shown in FIG. 2 and the respective flow arranging holes 45 shown in FIG. 3, the restricted portions 36 (the lower holes 25*b*) of the respective flow arranging holes 25 of the flow arranging plate 26 shown in FIG. 2 are equal to each other in diameter d and axial length L in the entire range from the center to the periphery of the flow arranging plate 26, while the restricted portions 56 (the lower holes) of the respective flow arranging holes 45 of the flow arranging plate 46 shown in FIG. 3 become gradually smaller in diameter d in the range from the center to the periphery of the flow arranging plate 46, though equal to each other in axial length L.

If the pressure acting on the top surface of the spinneret 44 is not so large as to deform the spinneret 44, the pressure plate 52 is not required to be used. In this case, the integral filter plate 55 is placed on the top surface of the spinneret 44 in the second space 50.

In the pack 41, a pressurized molten polymer flows into the first space 49 from the polymer introducing hole 47 of the pack cap 48. The introduced polymer fills the first space 49. The polymer filling the first space 49 flows into the upper holes 25*a* of the respective flow arranging holes 45, and passes through the connecting holes 25*c* and the lower holes 25*b*, flowing into the upper space 53 of the second space 50.

The polymer flowing into the upper space 53 of the second space 50 passes through the integral filter plate 55 and further through the many polymer flowing holes 51 of the pressure plate 52 into the lower space 54 of the second space 50, to fill the lower space 54. The polymer filling the lower space 54 is continuously extruded as filaments from the respective spinning holes 43 of the spinneret 44. The extruded many filaments are cooled and form a yarn.

The filaments of the obtained yarn are further less uneven in fineness compared to those obtained by using the pack shown in FIG. 2. The reasons are that the pack 41has the restricted portions 56 in the flow arranging holes 45 of the flow arranging plate 46, and that the restricted portions 56 become gradually smaller in hole diameter d in the range from the center to the periphery of the flow arranging plate 46. If the unevenness of fineness is still large, it can be lessened by readjusting the relation between the diameter D of the upper hole 25*a* of each flow arranging hole 25 and the diameter d of the lower hole 25*b*, and the diameters d of the respective lower holes 25*b* regionally different in the range from the center to the periphery of the flow arranging plate 46.

The diameters d of the lower holes 25*b* are selected to satisfy the following relation. The cross sectional area of the restricted portions 56 of the flow arranging holes 45 positioned in the peripheral region of the flow arranging plate 45 is kept smaller than the cross sectional area of the restricted portions 56 of the flow arranging holes 45 positioned in the central region of the flow arranging plate 46, and if the flow arranging holes 45 exist also in an intermediate region between the peripheral region and the central region, the cross sectional area of the restricted portions 56 of the flow arranging holes 45 positioned in the intermediate region is kept not smaller than the cross sectional area of the restricted portions 56 of the flow arranging holes 45 positioned in the peripheral region and not larger than the cross sectional area of the restricted portions 56 of the flow arranging holes 45 positioned in the central region.

Figure 5:
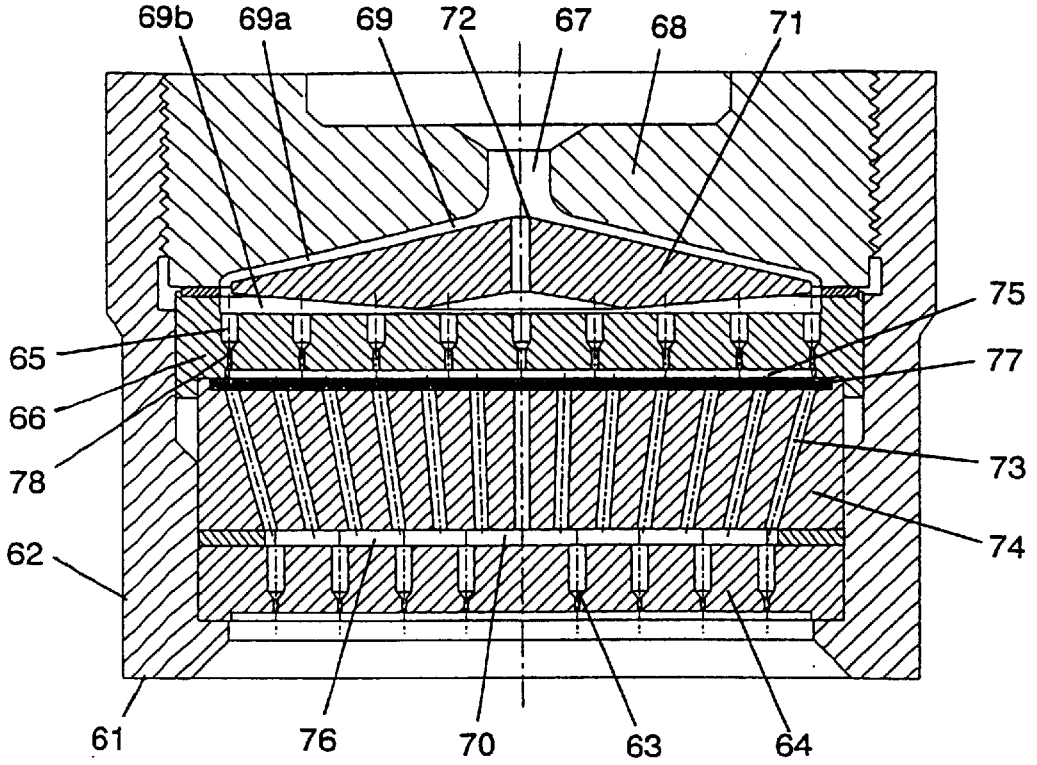
FIG. 5 is a vertical sectional view showing a further other example of the melt spinning pack of the present invention.

FIG. 5 is a vertical sectional view showing a further other example of the melt spinning pack of the present invention.

The pack 61 shown in FIG. 5 comprises a cylindrical pack case 62 opened in the bottom surface and the top surface, and a spinneret 64 having many spinning holes 63, a flow arranging plate 66 having many flow arranging holes 65, and a pack cap 68 having a polymer introducing hole 67at the center, respectively contained in this order from the bottom to the top of the pack case 62. The opening in the bottom surface of the pack case 62 is closed by the spinneret 64. The opening in the top surface of the pack case 62 is closed by the pack cap 68.

Between the bottom surface of the pack cap 68 and the top surface of the flow arranging plate 66, a first space 69 in which the outlet of the polymer introducing hole 67 and the inlets of the flow arranging holes 65 are opened is formed. Between the bottom surface of the flow arranging plate 66 and the top surface of the spinneret 64, a second space 70 in which the outlets of the flow arranging holes 65 and the inlets of the spinning holes 63 are opened is formed.

The top surface of the flow arranging plate 66 is flat. In the first space 69 between the top surface of the flow arranging plate 66 and the bottom surface of the pack cap 68, a sweeping plate 71 is positioned. The upper surface of the sweeping plate 71 is upwardly conical, and the bottom surface is downwardly conical though being upwardly conical in the central portion. The sweeping plate 71 has a polymer flowing hole 72 formed from the vertex of the conical top surface to the vertex of the conical form in the central portion of the bottom surface.

The bottom surface of the pack cap 68 is also upwardly conical to respond to the conical top surface of the sweeping plate 71. The vertical height of the clearance 69*a* between the two conical surfaces is almost uniform in the entire range from the outlet of the polymer introducing hole 67 to the periphery of the first space 69. The clearance 69*a* communicates to the clearance 69*b* between the bottom surface of the sweeping plate 71 and the top surface of the flow arranging plate 66.

The second space 70 is divided in to an upper space 75 and a lower space 76 by a pressure plate 74 having many polymer flowing holes 73 at an intermediate position of the second space 70 in the vertical direction. In the upper space 75, an integral filter plate 77 is placed on the top surface of the pressure plate 74.

In the pack 61, the many flow arranging holes 65 of the flow arranging plate 66 have restricted portions 78 reduced in cross sectional area compared to the inlets of the holes, in the sections between the inlets and the outlets.

The flow arranging holes 65 have the same form as the flow arranging holes 45 explained in reference to FIG. 3. The restricted portions 78 (the lower holes 25*b*) of the respective flow arranging holes 65 become gradually smaller in hole diameter d in the range from the center to the periphery of the flow arranging plate 66, though equal to each other in axial length L.

If the pressure acting on the top surface of the spinneret 64 is not so large as to deform the spinneret 64, the pressure plate 74 is not required to be used. In this case, the integral filter plate 77 is placed on the top surface of the spinneret 64 in the second space 70.

The integral filter plate 77can also be placed on the top surface of the flow arranging plate 66 instead of being placed on the top surface of the pressure plate 74, or one each of the integral filter plate 77 can also be placed on both the plates.

In the pack 61, a pressurized molten polymer flows in to the first space 69 from the polymer introducing hole 67 of the pack cap 68. The introduced polymer passes through the clearance 69*a* formed between the bottom surface of the pack cap 68 and the top surface of the sweeping plate 71 and through the polymer flowing hole 72 formed at the center of the sweeping plate 71, and flows in to the clearance 69*b* formed between the bottom surface of the sweeping plate 71 and the top surface of the flow arranging plate 66.

The polymer filling the clearance 69*a* flows in to the upper holes 25*a* of the respective flow arranging holes 65 and passes through the connecting holes 25*c* and the lower holes 25*b*, flowing in to the upper space 75 of the second space 70.

The polymer flowing in to the upper space 75 of the second space 70 passes through the integral filter plate 77 and further through the many polymer flowing holes 73 of the pressure plate 74, and flows in to the lower space 76 of the second space 70, filling the lower space 76. The polymer filling the lower space 76 is continuously extruded as filaments from the respective spinning holes 63 of the spinneret 64. The extruded many filaments are cooled and form a yarn.

The respective filaments of the obtained yarn are further less uneven in fineness compared to those obtained by using the pack shown in FIG. 3. The reasons are that the pack 61 has the restricted portions 78 in the flow arranging holes 65 of the flow arranging plate 66, that the restricted portions 78 become gradually smaller in hole diameter d in the range from the center to the periphery of the flow arranging plate 66, and that the first space 69 has the sweeping plate 71. If the unevenness of fineness is still large, it can be lessened by readjusting the relation between the diameter D of the upper hole 25*a* of each flow arranging hole 25 and the diameter d of the lower hole 25*b*, the diameters d of the respective lower holes 25*b* regionally different in the range from the center to the periphery of the flow arranging plate 46, and the form of the sweeping plate 71.

Figure 6:
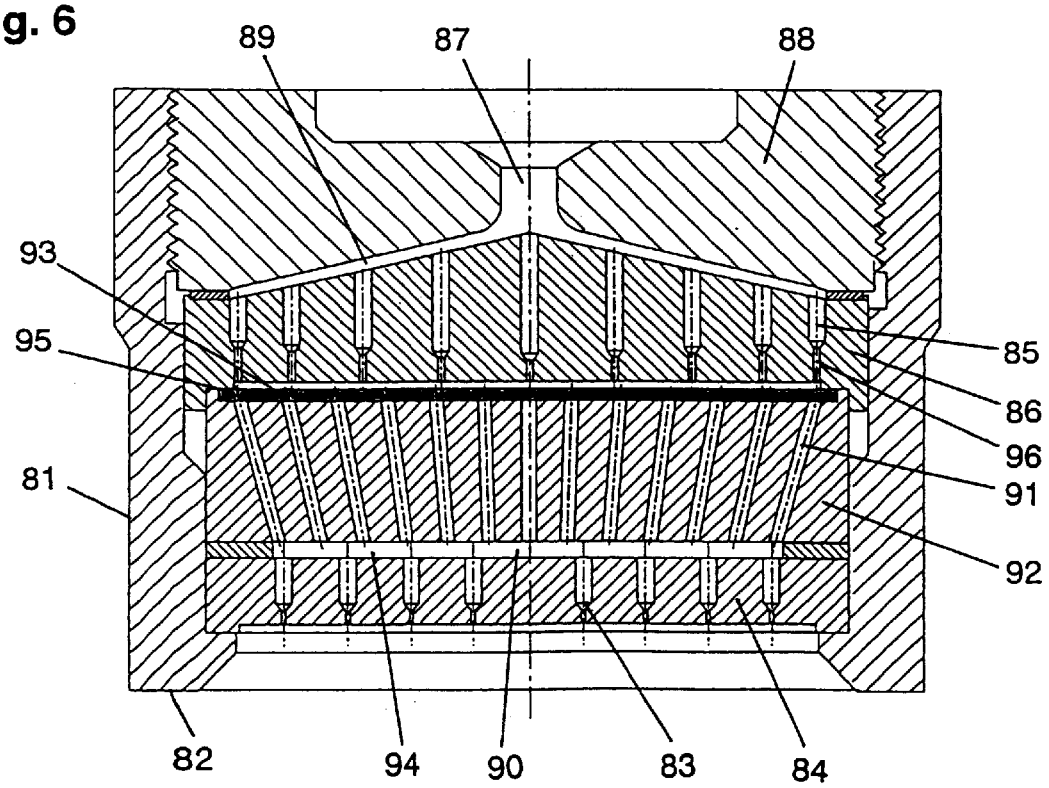
FIG. 6 is a vertical sectional view showing a still further other example of the melt spinning pack of the present invention.

FIG. 6 shows a vertical sectional view showing a still further other example of the melt spinning pack of the present invention.

The pack 81 shown in FIG. 6 comprises a cylindrical pack case 82 opened in the bottom surface and the top surface, and a spinneret 84 having many spinning holes 83, a flow arranging plate 86 having many flow arranging holes 85 and a pack cap 88 having a polymer introducing hole 87 at the center, respectively in this order from the bottom to the top of the pack case 82. The opening in the bottom surface of the pack case 82 is closed by the spinneret 84. The opening in the top surface of the pack case 82 is closed by the pack cap 88.

Between the bottom surface of the pack cap 88 and the top surface of the flow arranging plate 86, first space 89 in which the outlet of the polymer introducing hole 87 and the inlets of the flow arranging holes 85 are opened is formed. Between the bottom surface of the flow arranging plate 86 and the top surface of the spinneret 84, a second space 90 in which the outlets of the flow arranging holes 85 and the inlets of the spinning holes 83 are opened is formed.

The top surface of the flow arranging plate 86 is upwardly conical, and the bottom surface of the pack cap 88 is also upwardly conical in response to the conical surface of the flow arranging plate 86. The space between the two conical surfaces is the first space 89. The vertical height of the clearance between the two conical surfaces is almost uniform in the entire range from the outlet of the polymer introducing hole 87 to the periphery of the first space 89.

The second space 90 is divided in to an upper space 93 and a lower space 94 by a pressure plate 92 having many polymer flowing holes 91 at an intermediate position of the second space 90 in the vertical direction. In the upper space 93, an integral filter plate 95 is placed on the top surface of the pressure plate 92.

In the pack 81, the many flow arranging holes 85 of the flow arranging plate 86 have restricted portions 96 reduced in cross sectional area compared to the inlets of the holes, in the sections between the inlets and the outlets.

The flow arranging holes 85 have the same form as the flow arranging holes 25 explained in reference to FIG. 2 and FIG. 7(*a*). As for the difference between the respective flow arranging holes 25 shown in FIG. 2 and the respective flow arranging holes 85 shown in FIG. 6, the restricted portions 36 (the lower holes 25*b*) of the respective flow arranging holes 25 of the flow arranging plate 26 shown in FIG. 2 are equal to each other in hole diameter d and axial length L in the entire range from the center to the periphery of the flow arranging plate 26, while the restricted portions 96 (lower holes) of the respective flow arranging holes 85 of the flow arranging plate 86 shown in FIG. 6 become gradually longer in axial length L in the range from the center to the periphery of the flow arranging plate 85, though equal to each other in hole diameter d.

If the pressure acting on the top surface of the spinneret 84 is not so large as to deform the spinneret 84, the pressure plate 92 is not required to be used. In this case, the integral filter plate 95 is placed on the top surface of the spinneret 84 in the second space 90.

In the pack 81, a pressurized molten polymer flows in to the first space 89 from the polymer introducing hole 87 of the pack cap 88. The introduced polymer fills the first space 89. The polymer filling the first space 89 flows in to the upper holes of the respective flow arranging holes 85 and passes through the connecting holes and the lower holes, flowing in to the upper space 93 of the second space 90.

The polymer flowing in to the upper space 93 of the second space 90 passes through the integral filter plate 95 and further through the many polymer flowing holes 91 of the pressure plate 92 and flows in to the lower space 94 of the second space 90, filling the lower space 94. The polymer filling the lower space 94 is continuously extruded as filaments from the respective spinning holes 83 of the spinneret 84. The extruded many filaments are cooled and form a yarn.

The respective filaments of the obtained yarn are further less uneven in fineness compared to the filaments obtained by using the pack shown in FIG. 2. The reasons are that the pack 81 has the restricted portions 96 in the flow arranging holes 85 of the flow arranging plate 86, and that the restricted portions 96 become gradually longer in axial length L in the range from the center to the periphery of the flow arranging plate 86. If the unevenness of fineness is still large, it can be lessened by readjusting the relation between the diameter D of the upper hole 25*a* of each flow arranging hole 85 and the diameter d of the lower hole 25*b*, and the axial lengths L of the respective lower holes 25*b* regionally different in the range from the center to the periphery of the flow arranging plate 86.

The axial lengths L of the lower holes 25*b* can be decided to satisfy the following relation. The length of the restricted portions 96 of the flow arranging holes 85 positioned in the peripheral region of the flow arranging plate 85 is kept longer than the length of the restricted portions 96 of the flow arranging holes 85 positioned in the central region of the flow arranging plate 86, and if the flow arranging holes 85 exist also in the intermediate region between the peripheral region and the central region, the length of the restricted portions 96 of the flow arranging holes 85 positioned in the intermediate region is kept not longer than the length of the restricted portions 96 of the flow arranging holes 85 positioned in the peripheral region and not shorter than the length of the restricted portions 96 of the flow arranging holes positioned in the central region.

FIGS. 7 are vertical sectional views showing seven examples ( (*a*) to (*g*)) of the flow arranging holes formed in the flow arranging plate of the melt spinning pack of the present invention.

FIG. 7(*a*) has already been explained.

The flow arranging hole 25B shown in FIG. 7(*b*) is a modification of the flow arranging hole 25 shown in (*a*), and has an intermediate hole 25B*d* between the upper hole 25*a* and the connecting hole 25*c*. In FIG. 7(*b*), the flow arranging plate 26B has flow arranging holes 25B, each consisting of a cylindrical upper hole 25B*a* with diameter D, a first connecting portion 25B*e* like a truncated cone in succession to it, a cylindrical intermediate hole 25B*d* in succession to it, a second connecting hole 25B*c* like a truncated cone in succession to it, and a cylindrical lower hole 25B*b* (restricted portion 36B) with diameter d in succession to it.

The flow arranging hole 25C shown in FIG. 7(*c*) is another modification of the flow arranging hole 25 shown in (*a*), and has an expanded hole 25C*d* expanded in diameter, downstream of the lower hole 25*b*. In FIG. 7(*c*), the flow arranging plate 26C has flow arranging holes 25C, each consisting of a cylindrical upper hole 25C*a* with diameter D, a first connecting hole 25C*c* like a truncated cone in succession to it, a cylindrical lower hole 25C*b* (restricted portion 36C) with diameter d in succession to it, a second connecting hole 25C*e* like an inverted truncated cone in succession to it, and a cylindrical enlarged hole 25C*d* with a diameter larger than said diameter d and smaller than said diameter D in succession to it.

The flow arranging hole 25D of a flow arranging plate 26D shown in FIG. 7(*d*) is a conical hole with diameter D at the top, and the outlet of the flow arranging hole 25D in the bottom surface of the flow arranging plate 26D forms a restricted portion 36D with diameter d.

The flow arranging hole 25E of a flow arranging plate 26E shown in FIG. 7(*e*) is a modification of the flow arranging hole 25D shown in (d),and somewhat curved at the top of a conical hole. The outlet of the flow arranging hole 25E in the bottom surface of the flow arranging plate 26E forms a restricted portion 36E.

The flow arranging hole 25F of a flow arranging plate 26F shown in FIG. 7(*f*) has a funnel-shaped upper hole 25F*a* with diameter D at the top, and a lower hole 25F*b* with diameter d in succession to it. The lower hole 25F*b* forms a restricted portion 36F.

The flow arranging hole 25G of a flow arranging plate 26G shown in FIG. 7(*g*) is a modification of the flow arranging hole 25F shown in (*f*) and the funnel-shaped upper hole 25F*a* of (f) is replaced by a semi-spherical upper hole 25G*a*. In succession to the upper hole 25F*a* is a lower hole 25G*b* with a diameter d which forms a restricted portion 36E.

Of the flow arranging holes shown in FIGS. 7(*a*) through (*g*), the flow arranging hole shown in (*a*) is recommended since desired restricted portions can be designed and since restricted portions as designed can be formed in the many flow arranging holes.

In the embodiments shown in FIGS. 2 through 6, it is preferable that the following relation is satisfied.

A case of the pack shown in FIG. 2 is described below. It is preferable that D and d are selected to satisfy the relation of $R \leqq 50\%$, where R is the contraction percentage represented by $(Sb/Sa)\times 100\%$, Sa is the sectional area of the upper hole 25*a* and Sb is the sectional area of the lower hole 25*b*.

If the above relation is satisfied, the flow resistance necessary for more uniformly distributing the molten polymer in to the first space 29 can be given to the polymer, and furthermore, the flow resistance of the polymer at the upper holes 25*a* of the flow arranging holes 25 can be lessened.

A case of the pack shown in FIGS. 3 and 4 is described below. In reference to FIG. 4, on the top surface of the flow arranging plate 46, the many flow arranging holes 45 are positioned with their centers on the four concentric circles 45*a*, 45*b*, 45*c* and 45*d* described around the center 45*o* of the flow arranging plate 46, with the number of the flow arranging holes on each circle kept not larger than that on the adjacent outer circle. The circles to have the flow arranging holes 45 positioned are called hole positioning circles 45*a*, 45*b*, 45*c* and 45*d*. When the diameter of each hole positioning circle, the number of flow arranging holes existing on each hole positioning circle, and the hole diameter and length of the restricted portions of the hole adjusting holes are variables, it is preferable for less unevenness of fineness that the relation of the following formula (I) or (II) is satisfied.

If there is a flow arranging hole at the center 45° of the flow arranging plate 46, it is preferable that the relation of the following formula (I) is satisfied.

$$0.5 \leqq (Ln/Tn)/(2 \times Lo/do) \leqq 2.5, \quad \text{(I)}$$

where $Tn = \sqrt[3]{(3 \times Nn \times dn^4/32/Dn)}$, do: Hole diameter of the restricted portion of the flow arranging hole positioned at the center of the flow arranging plate Lo: Length of the restricted portion of the flow arranging hole positioned at the center of the flow arranging plate dn: Hole diameter of the restricted portions of the flow arranging holes positioned on the n-th hole positioning circle from the center of the flow arranging plate Ln: Length of the restricted portions of the flow arranging holes positioned on the n-th hole positioning circle from the center of the flow arranging plate Dn: Diameter of the n-th hole positioning circle from the center of flow arranging plate Nn: Number of the flow arranging holes positioned on the n-th hole positioning circle from the center of the flow arranging plate.

If there is no flow arranging hole at the center 45° of the flow arranging plate 46, it is preferable that the relation of the following formula (II) is satisfied.

$$0.5 \leqq (Ln/Tn)/(L_1/T_1) \leqq 2.5, \quad \text{(II)}$$

where $Tn = \sqrt[3]{(3 \times Nn \times dn^4/32/Dn)}$, $Tn = \sqrt[3]{(3 \times N_1 \times d_1^4/32/D_1)}$ $d_1$: Hole diameter of the restricted portions of the flow arranging holes positioned on the innermost hole positioning circle $L_1$: Length of the restricted portions of the flow arranging holes positioned on the innermost hole positioning circle $D_1$: Diameter of the innermost hole positioning circle $N_1$: Number of the flow arranging holes positioned on the innermost hole positioning circle dn: Hole diameter of the restricted portions of the flow arranging holes positioned on the n-th hole positioning circle from the center of the flow arranging plate Ln: Length of the restricted portions of the flow arranging holes positioned on the n-th hole positioning circle from the center of the flow arranging plate Dn: Diameter of the n-th hole positioning circle from the center of flow arranging plate Nn: Number of the flow arranging holes positioned on the n-th hole positioning circle from the center of the flow arranging plate.

A case of the pack shown in FIG. 2 is described below. If the angle of the vertex of the conical top surface of the flow arranging plate 26 is α, it is preferable to select the angle α to satisfy $100° \leqq \alpha \leqq 180°$. If the angle is in th is range, the passage lengths of the polymer flowing in the first space 29 from the polymer introducing hole 27 to the respective flow arranging holes 25 become less different, to lessen the difference in the dwell time of the polymer flowing down through the respective flow arranging holes 25. This also makes the filaments obtained from the respective spinning holes 23 less uneven in fineness.

The integral filter plate is preferably a filter plate formed by a nonwoven fabric of metal fibers. In this case, it is preferable that the diameter of the metal fibers used in the nonwoven fabric is 5 to 50 μm. It is preferable that the areal unit weight of the metal fibers used in the nonwoven fabric is 50 to 2,000 g/m$^2$. The filter plate is a s ingle nonwoven fabric of metal fibers or a laminate consisting of nonwoven fabrics of metal fibers.

If one each integral filter plate is used on the top surface of the pressure plate and the top surface of the flow arranging plate, it is preferable that the diameter of the metal fibers used in the nonwoven fabric placed on the top surface of the flow arranging plate is 5 to 200 μm.

EXAMPLES

The present invention is described below in detail in reference to examples.

Example 1 and Comparative Example 1

As the melt spinning pack for Example 1, the same melt spinning pack 21 of the present invention as shown in FIG. 2, except that it did not have the pressure plate 32 was used. The contraction percentage R of the restricted portions of the flow arranging holes 25 of the flow arranging plate 26 was 16%. As the integral filter plate 35, a nonwoven fabric of metal fibers with a diameter of 20 μm and an areal unit weight of 800 g/m$^2$ was used. The number of the spinning holes 23 of the spinneret 24 was 48. The 48 spinning holes were divided in to two equal 20 portions, for obtaining two yarns (the first and second yarns) respectively consisting of 24 filaments.

As the melt spinning pack for Comparative Example 1, the conventional melt spinning pack shown in FIG. 1 was used. The number of the spinning holes 3 of the spinneret 4 was 48. The 48 spinning holes were divided in to two equal portions, for obtaining two yarns (the first and second yarns) respectively consisting of 24 filaments.

Both the packs were used to melt-spin nylon 6 respectively. The spun yarns were drawn and wound. Each yarn was intended to achieve a fineness of 70 deniers.

The properties of the respectively obtained yarns and the polymer dwell times (the times taken for the polymer introduced from the polymer introducing hole to go out of the spinning holes) of the respective packs are shown in Table 1.

TABLE 1

| | | Example 1 | Comparative Example 1 |
|---|---|---|---|
| Total fineness | First yarn (deniers) | 69.8 | 68.9 |
| | Second yarn (deniers) | 70.2 | 71.1 |
| Fineness difference | Between yarns (deniers) | 0.4 | 2.2 |
| | Within yarn (%) | 2.5 | 4.8 |
| | Dwell time (sec) | 90 | 150 |

It can be seen that the finenesses (69.8 and 70.2 deniers) of the yarns produced by using the pack of the present invention (Example 1) were closer to the intended fineness (70 deniers) than the finenesses (68.9 and 71.1 deniers) of the yarns produced busing the conventional pack (Comparative Example 1).

It can be seen that the fineness difference between the first and second yarns produced by using he pack of the present invention (Example 1) was 0.4 denier, while that by using the conventional pack (Comparative Example 1) was 2.2 deniers, and therefore that the latter was 5 to 6 times the former.

The fineness difference (%) with in each yarn was obtained from the following formula: Fineness difference with in each yarn (%)=[(Standard deviation of finenesses of the respective filaments constituting the yarn)/ (Arithmetical mean of the finenesses of the respective filaments constituting the yarn)]×100.

The fineness difference with in each yarn of the yarns produced by using the pack of the present invention was 2.5%, while that by using the conventional pack (Comparative Example 1) was 4.8%. The latter was about twice the former.

The dwell time (90 seconds) of the present invention (Example 1) was far shorter than that (150 seconds) of the conventional example (Comparative Example 1). Th is means that the polymer was less deteriorated by heat in the pack of the present invention, being advantageous for producing fibers with good quality.

Example 2 and Comparative Example 2

As the melt spinning pack for Example 2, the melt spinning pack 41 of the present invention shown in FIGS. 3 and 4 was used. The angle α of the vertex of the conical top surface of the flow arranging plate 46 was 160°. As the integral filter plate 55, a woven fabric of metal fibers with a diameter of 20 μm and an areal unit weight of 800 g/m$^2$ was used. The number of the spinning holes 43 of the spinneret 44 was 48. The 48 spinning holes were divided in to two equal portions, for obtaining two yarns (the first and second yarns) respectively consisting of 24 filaments. The other conditions are shown in Table 2.

As the melt spinning pack for Comparative Example 2, the conventional melt spinning pack shown in FIG. 1 was used. The number of the spinning holes 3 of the spinneret 4 was 48. The 48 spinning holes were divided in to two equal portions, for obtaining two yarns (the first and second yarns) respectively consisting of 24 filaments.

Both the packs were used to melt-spin nylon 6 respectively, and the spun yarns were drawn and wound. Each yarn was intended to achieve a fineness of 70 deniers.

The properties of the respectively obtained yarns and the polymer dwell times in the respective packs are shown in Table 3.

TABLE 2

| Position of flow arranging holes | Number of flow arranging holes | Diameter of flow arranging holes D (mm) | Hole diameter of restricted portions d (mm) | Length of restricted portions L (mm) | Diameter of hole positioning circle (mm) |
|---|---|---|---|---|---|
| Center 45o | 1 | 2.0 | 0.8 | 9.0 | 0 |
| 1st circle 45a | 25 | 2.0 | 0.7 | 9.0 | 28 |
| 2nd circle 45b | 45 | 2.0 | 0.7 | 9.0 | 58 |
| 3rd circle 45c | 50 | 2.0 | 0.7 | 9.0 | 77 |
| 4th circle 45d | 60 | 2.0 | 0.6 | 9.0 | 90 |

TABLE 3

| | | Example 2 | Comparative Example 2 |
|---|---|---|---|
| Total fineness | First yarn (deniers) | 70.2 | 68.9 |
| | Second yarn (deniers) | 69.9 | 71.1 |
| Fineness difference | Between yarns (deniers) | 0.3 | 2.2 |
| | Within yarn (%) | 2.3 | 4.8 |
| | Dwell time (sec) | 90 | 150 |

It can be seen that the finenesses (70.2 and 69.9 deniers) of the yarns produced by using the pack of the present invention (Example 2) were closer to the intended fineness (70 deniers) than the finenesses (68.9 and 71.1 deniers) of the yarns produced by using the conventional pack (Comparative Example 2).

It can be seen that the fineness difference between the first and second yarns produced by using the pack of the present invention (Example 2) was 0.3 denier, while that by using the conventional pack (Comparative Example 2) was 2.2 deniers, and therefore that the latter was about 7 times the former.

The fineness difference with in each yarn of the yarns produced by using the pack of the present invention (Example 2) was 2.3%, while that by using the conventional pack (Comparative Example 2) was 4.8%. The latter was about twice the former.

The dwell time ( 90 seconds) of the present invention (Example 2) was far shorter than that (150 seconds) of the conventional example (Comparative Example 2). Th is means that the polymer was less deteriorated by heat in the pack of the present invention, being advantageous for producing fibers with good quality.

Example 3 and Comparative Example 3

As the melt spinning pack for Example 3, the melt spinning pack 41 of the present invention shown in FIGS. 3 and 4 was used. The angle α of the vertex of the conical top surface of the flow arranging plate 46 was 180°. As the integral filter plate 55, a nonwoven fabric of metal fibers with a diameter of 20 μm and an areal unit weight of 800 g/m$^2$ was used. The number of the spinning holes 43 of the spinneret 44 was 40. The 40 spinning holes were divided in to four equal quarters across the center of the spinneret 44, for obtaining four yarns (the first, second, third and fourth yarns) respectively consisting of 10 filaments. The other conditions are shown in Table 4.

As the melt spinning pack for Comparative Example 3, the conventional melt spinning pack shown in FIG. 1 was used. The number of the spinning holes 3 of the spinneret 4 was 40. The 40 spinning holes were divided in to four equal quarters across the center of the spinneret 4, for obtaining four yarns (the first, second, third and fourth yarns) respectively consisting of 10 filaments.

Both the packs were used to melt-spin nylon 6 respectively, and the spun yarns were drawn and wound. Each yarn was intended to achieve a fineness of 30 deniers.

The properties of the respectively obtained yarns and the polymer dwell times in the respective packs are shown in Table 5.

TABLE 4

| Position of flow arranging holes | Number of flow arranging holes | Diameter of flow arranging holes D (mm) | Hole diameter of restricted portions d (mm) | Length of restricted portions L (mm) | Diameter of hole positioning circle (mm) |
|---|---|---|---|---|---|
| Center 45o | 1 | 2.0 | 0.6 | 7.0 | 0 |
| 1st circle 45a | 15 | 2.0 | 0.6 | 7.3 | 24 |
| 2nd circle 45b | 30 | 2.0 | 0.6 | 7.6 | 46 |
| 3rd circle 45c | 46 | 2.0 | 0.6 | 8.0 | 70 |
| 4th circle 45d | 55 | 2.0 | 0.6 | 8.5 | 94 |

TABLE 5

| | | Example 3 | Comparative Example 3 |
|---|---|---|---|
| Total fineness | 1st yarn (deniers) | 29.5 | 31.0 |
| | 2nd yarn (deniers) | 30.4 | 30.5 |
| | 3rd yarn (deniers) | 30.6 | 29.9 |
| | 4th yarn (deniers) | 29.5 | 28.6 |
| Fineness difference | Between yarns (deniers) | 1.1 | 2.4 |
| | Dwell time (sec) | 270 | 650 |

In Table 5, the fineness difference refers to the difference between the maximum total fineness and the minimum total fineness of the four yarns. In the conventional example (Comparative Example 3), the fineness difference was 2.4 deniers, but it decreased to 1.1 in the present invention (Example 3).

The dwell time (270 seconds) of the polymer in the pack of the present invention (Example 3) was far shorter than the dwell time (650 seconds) in the conventional example (Comparative Example 3). Th is means that the polymer was less deteriorated by heat in the pack of the present invention, being advantageous for producing fibers with good quality.

Comparative Example 4

The melt spinning pack used for Comparative Example 4 was the melt spinning pack disclosed in FIG. 1 of Japanese Patent Publication (Kokoku) No. SHO 39-24309 as said publicly known document. The diameter of the flow arranging holes of the flow arranging plate (breaker plate) was 2 mm. The spinneret used was the same as that used for Example 3. On the upper flow arranging plate indicated by symbol 8 in FIG. 1 of Japanese Patent Publication (Kokoku) No. SHO 39-24309 as said publicly known document, the same integral filter plate as used in Example 3 was placed.

The pack was used to melt-spin the same nylon 6 as used in Example 3, and the spun yarns were drawn and wound. Each yarn was intended to achieve a fineness of 30 deniers.

The properties of the obtained yarns, the dwell time of the polymer in the pack and the yarn breaking frequency during spinning are shown in Table 6 together with the results of Example 3.

TABLE 6

| | | Example 3 | Comparative Example 4 |
|---|---|---|---|
| Total fineness | 1st yarn (deniers) | 29.5 | 28.9 |
| | 2nd yarn (deniers) | 30.4 | 31.0 |
| | 3rd yarn (deniers) | 30.6 | 31.1 |
| | 4th yarn (deniers) | 29.5 | 29.0 |
| Fineness difference | Between yarns (deniers) | 1.1 | 2.2 |
| | Yarn breaking frequency (times/per ton) | 0.5 | 2.0 |
| | Dwell time (sec) | 270 | 670 |

The fineness difference in the conventional example (Comparative Example 4) was 2.2 deniers, but that of the present invention (Example 3) decreased to 1.1.

The yarn breaking frequency during spinning was 2.0 (times/per ton) in the conventional example (Comparative Example 4), but that in the present invention (Example 3) was 0.5 (time/per ton), being improved to ¼.

The dwell time (270 seconds) of the polymer in the pack of the present invention (Example 3) was far shorter than the dwell time (670 seconds) in the conventional example (Comparative Example 4). This means that the polymer was less deteriorated by heat in the pack of the present invention, being advantageous for producing fibers with good quality.

INDUSTRIAL APPLICABILITY

The melt spinning pack of the present invention can be used for producing synthetic fibers with good quality, and is especially suitable for producing a plurality of synthetic fiber yarns less uneven in fineness respectively consisting of fibers less uneven in fineness.

What is claimed is:

1. A melt spinning pack, comprising:

(a) a cylindrical pack case opened in the bottom surface and the top surface, (b) a spinneret having many spinning holes, positioned to close the opening in the bottom surface of the pack case, (c) a flow arranging plate having many flow arranging holes having upper holes and lower holes, positioned above the spinneret, (d) a pack cap having a polymer introducing hole at the center, positioned above the flow arranging plate and positioned to close the opening in the top surface of the pack case, (e) a first space in which the outlet of the polymer introducing hole in the bottom surface of the pack cap and the inlets of the flow arranging holes in the top surface of the flow arranging plate are opened, (f) a second space in which the outlets of the flow arranging holes in the bottom surface of the flow arranging plate and the inlets of the spinning holes in the top surface of the spinneret are opened, and in which the space thickness in the central axis direction of the pack case is substantially uniform in the entire range of the space, and (g) restricted portions reduced in cross sectional area compared to the inlets of the flow arranging holes in the respective sections between the inlets of the flow arranging holes and the outlets of the flow arranging holes in direct or indirect succession to the upper holes of said flow arranging holes, and satisfying the following formula:

$$R \leqq 50\%,$$

where:

R=the contraction percentage represented by the formula (Sb/Sa)×100%;

Sa=sectional area of said upper hole of said flow arranging hole; and

Sb=sectional area of said lower hole of said flow arranging hole.

2. A melt spinning pack, according to claim 1, wherein the number of the flow arranging holes positioned in the peripheral region of the flow arranging plate is larger than the number of the flow arranging holes positioned in the central region of the flow arranging plate.

3. A melt spinning pack, according to claim 2, wherein, if flow arranging holes are positioned only in the peripheral region and the central region of the flow arranging plate, the cross sectional area of the restricted portions of the flow arranging holes positioned in the peripheral region of the flow arranging plate is smaller than the cross sectional area of the restricted portion(s) of the flow arranging hole(s) positioned in the central region of the flow arranging plate, and if flow arranging holes are positioned in the intermediate region between the peripheral region and the central region, the cross sectional area of the restricted portions of the flow arranging holes positioned in the peripheral region of the flow arranging plate is smaller than the cross sectional area of the restricted portion(s) of the flow arranging hole(s) positioned in the central region of the flow arranging plate and the cross sectional area of the restricted portions of the flow arranging holes positioned in the intermediate region is not smaller than the cross sectional area of the restricted portions of the flow arranging holes positioned in the peripheral region and not larger than the cross sectional area of the restricted portion(s) of the flow arranging hole(s) positioned in the central region.

4. A melt spinning pack, according to claim 2 or 3, wherein, if flow arranging holes are positioned only in the peripheral region and the central region of the flow arranging plate, the length of the restricted portions of the flow arranging holes positioned in the peripheral region of the flow arranging plate is longer than the length of the restricted portion(s) of the flow arranging hole(s) positioned in the central region of the flow arranging plate, and if flow arranging holes are positioned in the intermediate region between the peripheral region and the central region, the length of the restricted portions of the flow arranging holes positioned in the peripheral region of the flow arranging plate is longer than the length of the restricted portion(s) of the flow arranging hole(s) positioned in the central region of the flow arranging plate and the length of the restricted portions of the flow arranging holes positioned in the intermediate region is not longer than the length of the restricted portions of the flow arranging holes positioned in the peripheral region and not shorter than the length of the restricted portion(s) of the flow arranging hole(s) positioned in the central region.

5. A melt spinning pack, according to claim 2, wherein the form of the top surface of the flow arranging plate is upwardly conical or pyramidal and the form of the bottom surface of the pack cap is conical or pyramidal to respond to the conical or pyramidal top surface of the flow arranging plate, with the first space formed between the two conical or pyramidal faces.

6. A melt spinning pack, according to claim 2, wherein an integral filter plate formed by an integral filter medium is provided in the first or second space.

7. A melt spinning pack, according to claim 2, wherein the space thickness of the second space is about 1 to about 60 mm.

8. A melt spinning pack, according to claim 1, wherein the inner peripheral face of the cylindrical pack case, the outer peripheral face of the flow arranging plate and the outer peripheral face of the pack cap are respectively circular in cross sectional form.

9. A melt spinning pack, according to claim 8, wherein the flow arranging holes are positioned in such a manner that the centers of the flow arranging holes are positioned on a hole positioning circle described around the center of the top surface of the flow arranging plate, or positioned at the center of the top surface of the flow arranging plate and on a hole positioning circle described around said center.

10. A melt spinning pack, according to claim 9, wherein a plurality of concentric hole positioning circles are described instead of said one hole positioning circle.

11. A melt spinning pack, according to claim 10, wherein the number of flow arranging holes positioned on a hole positioning circle described in the peripheral region of the flow arranging plate is larger than the number of flow arranging holes positioned on a hole positioning circle described in the central region of the flow arranging plate.

12. A melt spinning pack, according to claim 11, wherein, if flow arranging holes are positioned only in an innermost central region and on an outermost hole positioning circle, the cross sectional area of the restricted portions of the flow arranging holes positioned on the outermost hole positioning circle of the flow arranging plate is smaller than the cross sectional area of the restricted portion(s) of the flow arranging hole(s) positioned in the innermost central region of the flow arranging plate, and if there is an intermediate hole positioning circle between the outermost hole positioning circle and the innermost central region, the cross sectional area of the restricted portions of the flow arranging holes positioned on the outermost hole positioning circle of the flow arranging plate is smaller than the cross sectional area of the restricted portion(s) of the flow arranging hole(s) positioned in the innermost central region of the flow arranging plate and the cross sectional area of the restricted portions of the flow arranging holes positioned on the intermediate hole positioning circle is not smaller than the cross sectional area of the restricted portions of the flow arranging holes positioned on the outermost hole positioning circle and not larger than the cross sectional area of the restricted portion(s) of the flow arranging hole(s) positioned in the innermost central region.

13. A melt spinning pack, according to claim 11 or 12, wherein, if flow arranging holes are positioned only in an innermost central region and on an outermost hole positioning circle, the length of the restricted portions of the flow arranging holes positioned on the outermost hole positioning circle of the flow arranging plate is longer than the length of the restricted portion(s) of the flow arranging hole(s) positioned in the innermost central region of the flow arranging plate, and if there is an intermediate hole positioning circle between the outermost hole positioning circle and the flow arranging hole(s) positioned in the innermost central region, the length of the restricted portions of the flow arranging holes positioned on the outermost hole positioning circle of the flow arranging plate is longer than the length of the restricted portion(s) of the flow arranging hole(s) positioned on the innermost central region of the flow arranging plate and the length of the restricted portions of the flow arranging holes positioned in the intermediate hole positioning circle is not longer than the length of the restricted portions of the flow arranging holes positioned on the outermost hole positioning circle and not shorter than the length of the restricted portion(s) of the flow arranging hole(s) positioned in the innermost central region.

14. A melt spinning pack, according to claim 11, wherein the form of the top surface of the flow arranging plate is upwardly conical or pyramidal, and the form of the bottom surface of the pack cap is conical or pyramidal to respond to the conical top surface of the flow arranging plate, with the first space formed between the two conical surfaces.

15. A melt spinning pack, according to claim 11, wherein an integral filter medium is provided in the first or second space.

16. A melt spinning pack, according to claim 8, wherein the space thickness of the second space is about 1 to about 60 mm.

17. A method for producing synthetic fibers, characterized by using the melt spinning pack stated claim 1, introducing a molten polymer form the polymer introducing hole of the pack cap, spinning many filaments from the spinning holes of the spinneret and cooling the filaments to form a yarn.

18. A method for producing synthetic fibers, characterized by using the melt spinning pack stated claim 8, introducing a molten polymer from the polymer introducing hole of the pack cap, spinning many filaments from the spinning holes of the spinneret and cooling the filaments to form a yarn.

19. A method for producing synthetic fibers, according to claim 17 or 18, wherein the molten polymer is a polyester containing an electro-control agent.

20. A melt spinning pack, according to claim 1, wherein a flow arranging hole is positioned at the center of the flow arranging plate and satisfying the following formula:

$$0.5 \leqq (Ln/Tn)/(2 \times Lo/do) \leqq 2.5,$$

where:

$Tn = \sqrt[3]{(3 \times Nn \times dn^4/32/Dn)}$, do=hole diameter of the restricted portion of the flow arranging hole positioned at the center of the flow arranging plate;

Lo=length of the restricted portion of the flow arranging hole positioned at the center of the flow arranging plate;

dn=hole diameter of the restricted portions of the flow arranging holes positioned on the nth hole positioning circle from the center of the flow arranging plate;

Ln=length of the restricted portions of the flow arranging holes positioned on the nth hole positioning circle from the center of the flow arranging plate;

Dn=diameter of the nth hole positioning circle from the center of the flow arranging plate; and Nn=number of the flow arranging holes positioned on the nth hole positioning circle from the center of the flow arranging plate.

21. A melt spinning pack, according to claim 1, wherein flow arranging holes are positioned only on concentric hole positioning circles located a distance D away from the center of the flow arranging plate and satisfying the following formula:

$$0.5 \leqq (Ln/Tn)/(Ll/Tl) \leqq 2.5,$$

where:

$Tn = \sqrt[3]{(3 \times Nn \times dn^4/32/Dn)}$, $T_1 = \sqrt[3]{(3 \times N_1 \times d_1^4/32/D_1)}$, $d_1$=hole diameter of the restricted portions of the flow arranging holes positioned on the innermost hole positioning circle of the flow arranging plate;

$L_1$=length of the restricted portion of the flow arranging hole positioned on the innermost hole positioning circle of the flow arranging plate;

$D_1$=diameter of the innermost hole positioning circle of the flow arranging plate;

$N_1$=number of the flow arranging holes positioned on the innermost hole positioning circle of the flow arranging plate;

dn=hole diameter of the restricted portions of the flow arranging holes positioned on the nth hole positioning circle from the center of the flow arranging plate;

Ln=length of the restricted portions of the flow arranging holes positioned on the nth hole positioning circle from the center of the flow arranging plate;

Dn=diameter of the nth hole positioning circle from the center of the flow arranging plate; and Nn=number of the flow arranging holes positioned on the nth hole positioning circle from the center of the flow arranging plate.

22. A melt spinning pack, according to claim 5, wherein an angle of vertex of the conical or pyramidal top surface of the flow arranging plate satisfies the following formula:

$$100° \leqq \leqq 180°.$$

23. A melt spinning pack, according to claim 1, further comprising a first integral filter plate positioned above said spinneret and below said flow arranging plate.

24. A melt spinning pack, according to claim 23, further comprising a second integral filter plate positioned above said flow arranging plate.

25. A melt spinning pack, according to claim 23 or claim 24, wherein said first integral filter plate is a nonwoven fabric of metal fibers.

26. A melt spinning pack, according to claim 25, wherein said metal fibers have a diameter in the range of 5–50 $\mu$m.

27. A melt spinning pack, according to claim 24, wherein said second integral filter plate is a nonwoven fabric of metal fibers.

28. A melt spinning pack, according to claim 27, wherein said metal finers have a diameter in the range of 5–200 $\mu$m.

29. A melt spinning pack, according to claim 25, wherein said metal fibers have an areal unit weight in the range of 50–2000 g/m$^2$.

* * * * *